United States Patent [19]

Nighan et al.

[11] Patent Number: 4,549,109

[45] Date of Patent: Oct. 22, 1985

[54] OPTICAL DISPLAY WITH EXCIMER FLUORESCENCE

[75] Inventors: William L. Nighan, Manchester; Walter J. Wiegand, Glastonbury; Carl M. Ferrar, East Hartford, all of Conn.

[73] Assignee: United Technologies Corporation, Hartford, Conn.

[21] Appl. No.: 625,199

[22] Filed: Jun. 28, 1984

Related U.S. Application Data

[63] Continuation of Ser. No. 322,098, Nov. 16, 1981, abandoned.

[51] Int. Cl.[4] ..... H01J 1/62; H01J 63/04

[52] U.S. Cl. ..... 313/485; 313/637; 313/642; 313/643; 315/169.4

[58] Field of Search ..... 313/637, 642, 643, 485; 315/169.4

[56] References Cited

U.S. PATENT DOCUMENTS 4,013,912 3/1977 Hinson ..... 313/643

OTHER PUBLICATIONS

Principles of Laser Plasmas, Wiley, George Bekefi, Ed.; pp. 422–424.

Rare Gas Halide Lasers, J. J. Ewing, *Physics Today,* May, 1978, pp. 32–29.

Blue Color AC Plasma Panel 1980, SID International Symposium Digest of Technical Papers.

*Primary Examiner*—William L. Sikes

*Assistant Examiner*—Robert E. Wise

*Attorney, Agent, or Firm*—Eric W. Petraske

[57] ABSTRACT

A display device employs an electric discharge passing through a mixture of gases to form an excimer that fluoresces in the blue/green region of the optical spectrum.

5 Claims, 7 Drawing Figures

OPTICAL DISPLAY WITH EXCIMER FLUORESCENCE

The Government has rights in this invention pursuant to Contract No. DAAG29-80-C-0019 awarded by the Department of the Army.

This is a continuation of application Ser. No. 322,098, filed Nov. 16, 1981, now abandoned.

DESCRIPTION

1. Technical Field

The field of the invention is that of display devices that express information by emission of visible light.

2. Background Art

In the field of display devices employing a gaseous emitting medium, such as neon bulbs, seven-segment displays, numerical indicator tubes and plasma display panels, the standard gas mixture has usually been predominantly neon, often with small admixtures of other rare gases such as xenon or argon which improve the electrical characteristics via the Penning effect. These mixtures emit in the orange/red region of the optical spectrum, towards the low end of the response of the average eye. Workers in the field have long sought a gas or gaseous mixture that would emit in the green or blue region of the spectrum where the eye, especially when dark adapted, is more sensitive. Among the most successful mixtures explored to date have been those described in an article by G. F. Watson, Journal of Physics E8, 981 (1975). One approach utilizes a gaseous mixture which emits in the ultraviolet, the ultraviolet radiation being converted to visible light by means of a phosphor coated on one side of the glass enclosing the gas mixture. This approach suffers from the drawback that the phosphor tends to reduce the resolution of the display device since the light emitted by the phosphor extends over a wider area than the actual discharge in the gaseous mixture. An alternative approach is disclosed in a paper by O. Sahni in the 1980 SID International Symposium Digest of Technical Papers, April 1980, which described a mercury seeded gas mixture that must be temperature controlled. The necessity for temperature control is a considerable limitation in practical applications.

In the laser art, emission in the blue/green portion of the spectrum has been produced by excimer lasers employing high pressure gas mixtures on the order of several atmospheres and a high electron density discharge of at least $10^{14}$ electrons per cubic centimeter. A typical example is that by G. Marowsky et al, in the Journal of Chemical Physics 75, 1153 (1981).

DISCLOSURE OF INVENTION

The invention relates to an optical display device employing an electric discharge through a gaseous medium, in which excited or ionized species produced from the constituent gases of the medium react under the action of the discharge to form an excimer molecule that fluoresces in the visible or ultraviolet region of the electromagnetic spectrum.

BEST MODE FOR CARRYING OUT THE INVENTION

In the prior art of optical display devices, the most popular emitting medium has been neon, which is often used with small admixtures of rare gases such as xenon or argon, and which emits in the orange/red region of the visible spectrum. The neon emission is within the range of response of a light adapted eye but is poorly seen by a dark adapted eye. Those working in the art have long sought mixtures which would emit brightly in the visible region of the spectrum near the blue/green region where a dark adapted human eye is more sensitive. The prior art has been unable to achieve a reasonable degree of brightness in the desired spectral region, except at the cost of introducing undesirable features.

Commercially practicable optical display devices use operating pressures below or reasonably close to atmospheric, so that excessive reinforcement of large panes of glass is not required; and use only moderate amounts of voltage and current so that expensive power supplies are not required. These conditions are considerably different from the operating conditions of excimer lasers which feature very high pressures and very high electron current densities.

It has been found that it is possible to produce excimer (for the purpose of this patent, the term excimer shall mean both a homonuclear and a heteronuclear excited molecular complex) molecules in a mixture of gases with reasonable efficiency using pressure, voltages and currents appropriate to conventional plasma panels, thereby rendering commercially practical an optical display device using such a mixture. In a particular embodiment in which the excimer $Xe_2Cl^*$ is the emitting excimer, the excimer is formed by means of the following reaction sequence:

$$e + Xe\text{-}Xe^*(^3P_2) + e$$
$$Xe^* + Cl_2 \rightarrow XeCl^* + Cl$$
$$XeCl^* + Xe + M \rightarrow Xe_2Cl^* + M$$
$$Xe_2Cl^* \rightarrow 2Xe + Cl + h\nu 450\text{–}550:$$

where M is Ne or any suitable buffer gas.

It has been found that over a wide range of discharge conditions such as those typical of optical display devices, the precursor molecule $XeCl^*$ is produced with great efficiency (in the ten to thirty percent range), the efficiency being highest for an average electron temperature of approximately two to four electron volts. It has been further found that the efficiency of the formation of the triatomic excimer, $Xe_2Cl^*$, is sufficiently high so that brightness comparable to the prior art neon Penning mixtures may be achieved at pressures of the order of atmospheric.

Figure 1:
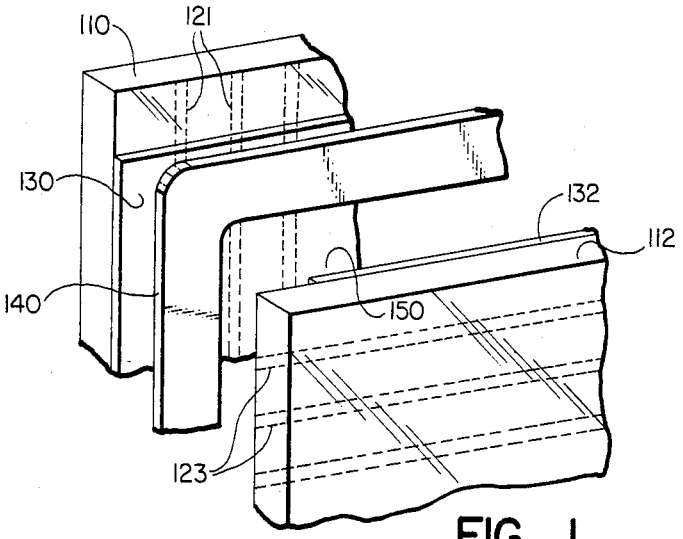
FIG. 1 illustrates an exploded view of an embodiment of the invention.

An excimer mixture as tested in the apparatus shown partially in exploded view in FIG. 1, in which glass plates 110 and 112 support X and Y electrodes 123 and 121, the intersections of which locate light emitting electrical discharges. The electrodes are isolated from the gas mixture by dielectric sheets 130 and 132, illustratively formed from a 0.025 millimeter glass dielectric coated with a 200 nanometer magnesium oxide electron emitting layer. The two dielectric sheets are separated by 0.1 millimeter by spacer sealer 140 and gas 150 occupies the space between them. Voltage pulses of controllable amplitude, 250 nanoseconds duration and 100 kilohertz repetition rate were applied to the exposed ends of electrodes 121 and 123. Capacitive coupling through the glass and magnesium oxide coatings produced discharges within the gas where the electrodes cross. The discharge emission was viewed through a CIE filtered photometer, the response of which approximates the response of the human eye in order to measure relative brightness as a function of pressure and voltage. The spectral content of the discharge emission was analyzed using a scanning monochrometer, with S-5 photomultiplier response. The illustrative gas mixture comprising nominally 20% xenon, 0.1% chlorine, the remainder neon, produced the test results shown in FIGS. 2 and 3.

Figure 2A:
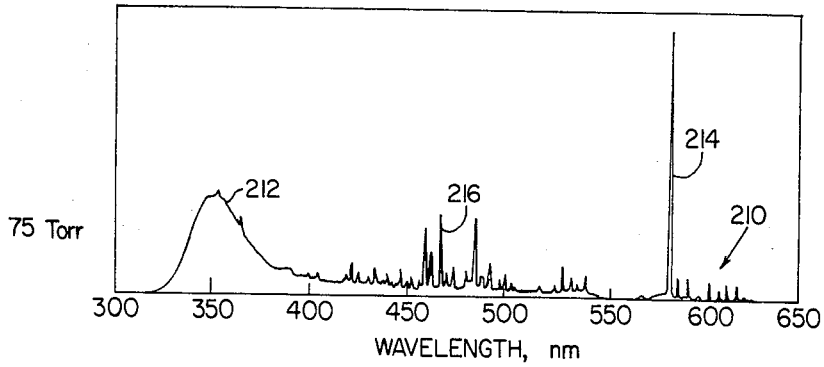
FIGS. 2A and 2B illustrate the wavelength dependence of an embodiment of the invention at different pressures.
Figure 2B:
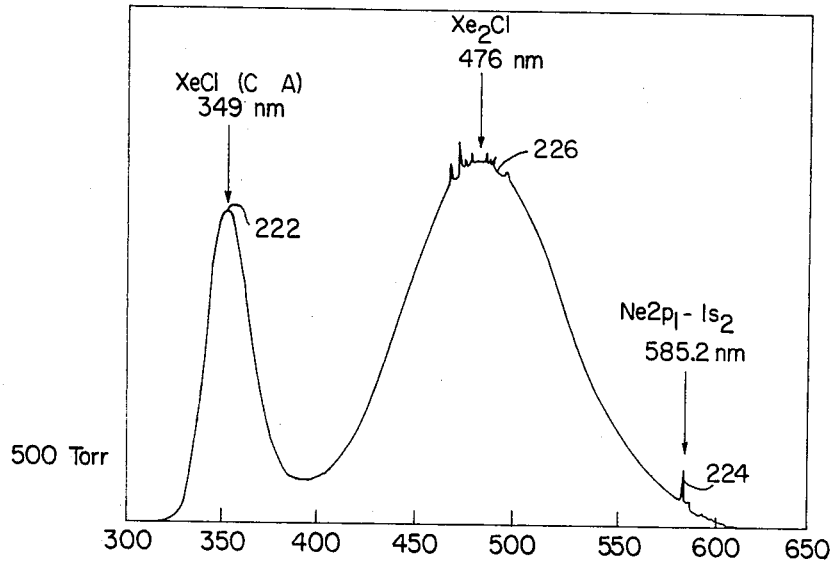

FIG. 2 illustrates the measured spectral response of the excimer mixture at two different pressures. FIG. 2A illustrates the response at a pressure of 75 Torr, showing peak 212 characteristic of XeCl* and peak 214 characteristic of the strongest visible transition in a neon-xenon Penning mixture, but showing only a very small intensity in the region 216 characteristic of $Xe_2Cl^*$. FIG. 2B illustrates the response of the same mixture at a pressure of 500 Torr showing, in addition to the XeCl peak 222 and the neon peak 224, a $Xe_2Cl^*$ peak 226 dominating the spectral output. It is noteworthy that the excimer species is excited with such great efficiency that the neon line 224 is relatively insignificant. Indeed, the characteristic neon color is not visible to the naked eye.

Figures 3A, 3B:
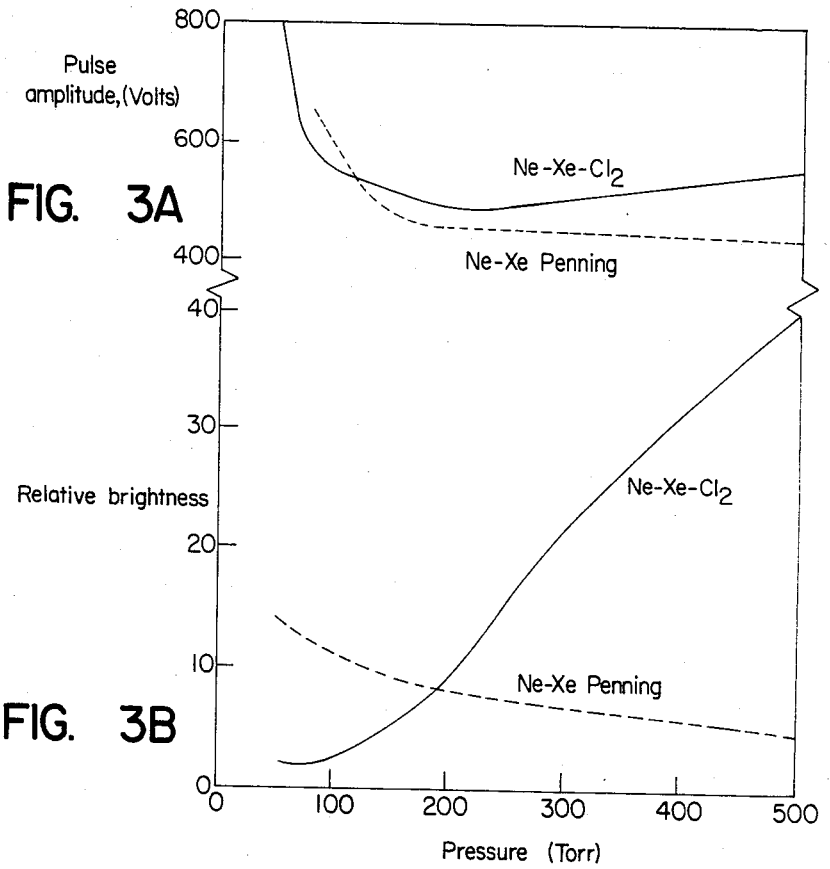
FIGS. 3A through 3B illustrate the pressure dependence of pulse amplitude and relative brightness of two different gaseous mixtures.

FIG. 3A illustrates the pressure dependence of that pulse amplitude in the embodiment of FIG. 1 which produces a discharge having a width of approximately one millimeter and FIG. 3B shows the relative brightness of two gas mixtures, the illustrative excimer gas mixture and the prior art neon-xenon Penning mixture. The discharge was viewed through a CIE filter and the units are arbitrary. It can be seen that the pulse amplitude is substantially similar for both gas mixtures so that the illustrative excimer mixture can be used with conventional power supplies appropriate for the prior art optical display devices and under similar operating conditions. In FIG. 3B, the illustrative excimer mixture exceeds the Penning mixture in brightness at a pressure above 200 Torr. The brightness curve is expected to keep on rising past 500 Torr, although difficulty may be encountered in keeping the discharge width less than a millimeter at higher pressures. For applications which do not require a discharge width of less than 1 millimeter, the preferred embodiment may have a pressure greater than 500 Torr.

Figure 4A:
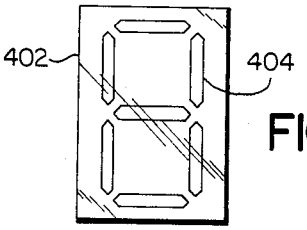
FIGS. 4A and 4B illustrate an alternative embodiment of the invention.
Figure 4B:
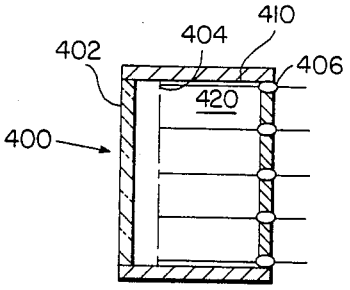

FIG. 4 illustrates an alternative embodiment of the invention, in which seven-segment character display tube 400 is shown in FIG. 4A, with semitransparent anode 402 through which are visible the seven cathode segments 404. FIG. 4B shows the display tube in side view, with the interior of gas-tight housing 410 filled with excimer gas mixture 420 and containing the cathodes 404, the leads of which enter housing 410 through feed-throughs 406. The cathodes are driven by conventional display logic circuits not shown that provide the required excitation voltage pulses.

The gaseous mixture may be any mixture of gases that react under the influence of an electric discharge to form an excimer that radiates in a desired spectral range. In addition to $Xe_2Cl$, suitable excimers that emit in the visible region are XeO, KrO, ArO, $Xe_2Br$ and XeF. Additional excimers that radiate in the ultraviolet and so may be used with a phosphor are $Ar_2$, $Kr_2$, $Xe_2$, ArF, KrF, XeF, ArCl, KrCl and XeCl. The compounds with the highest efficiency for producing radiation are believed to be combinations of at least one atom from an element in the zeroth column of the periodic table (such as argon, krypton and xenon) and at least one atom from an element in the seventh column (such as chlorine or fluorine).

The role of the neon in the reactions of the illustrative embodiment may be performed by any suitable buffer gas. The role of the $Cl_2$ may also be performed by chlorine-bearing compounds such as HCl, $CCl_4$ or chlorinated hydrocarbons which dissociate under the influence of an electric discharge. In the case of the excimer XeF, the fluorine donor may be $F_2$ or $NF_3$. Any electric discharge, such as AC, DC or RF may be used.

We claim:

1. An optical display device comprising:

a gas-tight enclosure, a portion of which is optically transmissive in the visible region of the electromagnetic spectrum, whereby optical display radiation may be emitted from said device;

a predetermined gaseous mixture comprising at least one gas species enclosed in said gas-tight enclosure;

a plurality of electrodes disposed in such a manner that a portion of radiation generated within said gas-tight enclosure in response to an electric discharge passing between at least two of said electrodes passes through said optically transmissive portion of said gas-tight enclosure;

means for passing an electric discharge between at least two of said electrodes; and a predetermined concentration of heteronuclear excimer states within said gaseous mixture that emit visible electromagnetic radiation upon dissociative de-excitation.

2. An optical display device comprising:

a gas-tight enclosure, a portion of which is optically transmissive in the visible region of the electromagnetic spectrum, whereby optical display radiation may be emitted from said device;

a predetermined gaseous mixture comprising at least one gas species enclosed in said gas-tight enclosure;

a plurality of electrodes disposed in such a manner that a portion of radiation generated within said gas-tight enclosure in response to an electric discharge passing between at least two of said electrodes passes through said optically transmissive portion of said gas-tight enclosure; and means for passing an electric discharge between at least two of said electrodes in such a manner that atoms from said at least one gas species react under the influence of said electric discharge to form at least one heteronuclear excimer state including at least one atom from an element in the zeroth column of the periodic table and at least one atom from an element in the seventh column of the periodic table that emits electromagnetic radiation upon dissociative de-excitation.

3. An optical display device according to claim 2, in which said excimer is a member of the group consisting of $Xe_2Cl$, XeCl and XeF.

4. An optical display device comprising:

a gas-tight enclosure, a portion of which is optically transmissive in the visible region of the electromagnetic spectrum, whereby optical display radiation may be emitted from said device;

a predetermined gaseous mixture comprising at least one gas species enclosed in said gas-tight enclosure;

a plurality of electrodes disposed in such a manner that a portion of radiation generated within said gas-tight enclosure in response to an electric discharge passing between at least two of said electrodes passes through said optically transmissive portion of said gas-tight enclosure and;

means for passing an electric discharge between at least two of said electrodes in such a manner that atoms from said at least one gas species react under the influence of said electric discharge to form at least one heteronuclear excimer state including at least one atom from an element in the zeroth column of the periodic table and at least one atom of oxygen that emits electromagnetic radiation upon dissociative de-excitation.

5. An optical display device according to claim 4, in which said at least one atom is xenon and said excimer is xenon oxide.

* * * * *